US009295318B2

(12) United States Patent
Fischer

(10) Patent No.: US 9,295,318 B2
(45) Date of Patent: Mar. 29, 2016

(54) PORTABLE WATER BACKPACK

(71) Applicant: Greif Flexibles Trading Holding B.V., Leiden (GB)

(72) Inventor: David Fischer, Dublin, OH (US)

(73) Assignee: GRIEF FLEXIBLES TRADING HOLDING B.V., Leiden (NL)

( * ) Notice: Subject to any disclaimer, the term of this patent is extended or adjusted under 35 U.S.C. 154(b) by 0 days.

(21) Appl. No.: 14/354,416

(22) PCT Filed: Oct. 26, 2012

(86) PCT No.: PCT/US2012/062134

§ 371 (c)(1),
(2) Date: Apr. 25, 2014

(87) PCT Pub. No.: WO2013/063402

PCT Pub. Date: May 2, 2013

(65) Prior Publication Data

US 2014/0353347 A1 Dec. 4, 2014

Related U.S. Application Data

(60) Provisional application No. 61/552,251, filed on Oct. 27, 2011.

(51) Int. Cl.
*A45F 3/16* (2006.01)
*A45F 3/04* (2006.01)
(Continued)

(52) U.S. Cl.
CPC . *A45F 3/16* (2013.01); *A45C 13/10* (2013.01); *A45F 3/04* (2013.01); *A45F 3/20* (2013.01); *A45C 2013/1007* (2013.01); *A45F 2003/166* (2013.01)

(58) Field of Classification Search
CPC ..... A45F 2003/166; A45F 3/16; A45F 3/20; A45C 13/10; A45C 13/1038; A45C 13/1046; A45C 13/1053; A45C 13/1061; A45C 2013/1007
USPC ..... 224/148.1–148.7, 600, 627–659; 383/104
See application file for complete search history.

(56) References Cited

U.S. PATENT DOCUMENTS 2,013,358 A * 9/1935 Osborne ..... 224/148.2
4,125,212 A * 11/1978 Courchesne ..... 294/157
(Continued)

FOREIGN PATENT DOCUMENTS

CN 1447661 A 10/2003
CN 200990969 Y 12/2007
(Continued)

OTHER PUBLICATIONS

Chinese Office Action mailed Apr. 17, 2015, with partial English translation.

*Primary Examiner* — Justin Larson
*Assistant Examiner* — Scott McNurlen
(74) *Attorney, Agent, or Firm* — Baker & Hostetler LLP

(57) ABSTRACT

The present invention provides in some embodiments, the first for purpose designed, low cost, easy to transport, ergonomically correct, water transport backpack and storage device for the least developed countries of the world. The backpack includes a carrier bag and a food-safe liner configured to be disposed within the carrier bag. The carrier bag includes handles and straps to enable the user to carry the bag comfortably for long distances. The carrier bag and the food-safe liner also include wide-mouthed tops for filling the backpack with water and can be rolled down and secured with ties, in order to keep the backpack closed. The food-safe liner includes a spout for dispensing the water. The backpack also includes a flattened bottom for positioning the backpack on a flat surface for storage. The components of the water backpack can be provided as a kit for local manufacture to provide jobs.

10 Claims, 11 Drawing Sheets

(51) Int. Cl.
*A45C 13/10* (2006.01)
*A45F 3/20* (2006.01)

(56) References Cited

U.S. PATENT DOCUMENTS

| | | | | |
|---|---|---|---|---|
| 4,193,518 | A * | 3/1980 | Holmes | 222/105 |
| 4,462,525 | A * | 7/1984 | Pingleton et al. | 224/634 |
| 4,836,416 | A * | 6/1989 | Shalgi et al. | 222/48 |
| 5,289,896 | A | 3/1994 | Giglio | |
| 5,318,209 | A * | 6/1994 | Rader et al. | 224/250 |
| 5,803,331 | A * | 9/1998 | Thorne et al. | 224/627 |
| 6,048,099 | A | 4/2000 | Muffett et al. | |
| 6,164,509 | A * | 12/2000 | Gausling et al. | 224/627 |
| 6,675,998 | B2 * | 1/2004 | Forsman et al. | 224/148.2 |
| 2002/0038811 | A1 * | 4/2002 | Vigny | 224/651 |
| 2003/0198408 | A1 * | 10/2003 | Mogil | 383/110 |
| 2004/0118942 | A1 | 6/2004 | Courtney | |
| 2004/0128747 | A1 * | 7/2004 | Bumbarger et al. | 2/458 |
| 2004/0234174 | A1 * | 11/2004 | Caudle | 383/104 |
| 2007/0090135 | A1 | 4/2007 | Benham | |
| 2007/0095867 | A1 * | 5/2007 | Tomlin | 224/148.2 |
| 2010/0127025 | A1 * | 5/2010 | Kelling | 224/153 |
| 2010/0155437 | A1 * | 6/2010 | Broadbent et al. | 224/148.1 |
| 2010/0206751 | A1 * | 8/2010 | Wessel | 206/38 |
| 2014/0353347 | A1 | 12/2014 | Fischer | |

FOREIGN PATENT DOCUMENTS

| | | | |
|---|---|---|---|
| CN | 201754913 | U | 3/2011 |
| EP | 2770870 | A1 | 9/2014 |
| WO | 2013063402 | A1 | 5/2013 |

* cited by examiner

PORTABLE WATER BACKPACK

CROSS-REFERENCE TO RELATED APPLICATIONS

This application is a National Stage of International Patent Application PCT/US2012/062134, filed Oct. 26, 2012, which claims priority to U.S. Provisional Application Ser. No. 61/552,251, filed Oct. 27, 2011, the disclosures of which are incorporated herein by reference in their entirety.

FIELD OF THE INVENTION

The present invention generally relates to a receptacle. More particularly, the present invention pertains to a backpack-style receptacle for transporting water.

BACKGROUND OF THE INVENTION

In many developing nations, potable water is not readily available within near distances. In fact, women in Africa walk an average of 3.5 miles a day to get water. Moreover, the average person needs 8-15 liters of water per day, and a family of 6 can require up to approximately 90 liters of water per day. Therefore, when potable water is not readily available in the home or within a near distance, the water must be transported in large amounts sometimes by walking long distances.

Often, people use plastic or metal jerry cans to transport the water over these distances. Jerry cans can be heavy and cumbersome even before the addition of the water to be transported. In addition, the jerry cans are often repurposed from other uses including lube oils, chemicals, paint, fuel and gasoline, transport and storage. Therefore, these cans can be laden with potentially carcinogenic chemicals.

It is therefore desirable to provide a designed for purpose, lightweight, ergonomically correct, easy-to-carry receptacle for transporting water over significant distances.

SUMMARY OF THE INVENTION

The foregoing needs are met, to a great extent, by the present invention, wherein in some embodiments a water backpack that is capable of overcoming the disadvantages described herein at least to some extent is provided.

An embodiment of the present invention pertains to a backpack for carrying water. The backpack includes a flexible body, a bottom, a lower opening, and a liner. The flexible body defines a maximum interior volume. The bottom is configured to provide sufficient support to the backpack for the backpack to be self-standing. The lower opening is disposed in a back side of the flexible body. The lower opening is located proximal to the bottom. The liner includes a translucent polymer envelope that is larger than the maximum interior volume and a valve configured to protrude through the lower opening.

Another embodiment of the present invention relates to a backpack for transporting water. The backpack includes a carrier bag, a liner, and shoulder straps. The carrier bag having front side and a back side and a top end and a bottom end. The top end defines an opening and the bottom end is configured to provide a stable base to stand the backpack upright. An outer wall of the carrier bag defines an internal volume. The liner bag provides a water tight receptacle for water to be carried in the carrier bag. The liner bag has a top end defining a liner bag opening and a bottom end. A spout for dispensing water is positioned near the bottom end of the liner bag. An outer wall of the liner bag defines an internal volume for transporting water. The shoulder straps are configured to be coupled to the back side of the carrier bag and to allow a user to carry the water backpack. The liner bag is disposed within the internal volume of the carrier bag.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

The present invention provides in some embodiments, a lightweight, portable backpack for transporting water over long distances. The backpack includes a carrier bag and a food-safe liner configured to be disposed within the carrier bag. The carrier bag includes handles and straps to enable the user to carry the bag comfortably for long distances. The carrier bag and the food-safe liner also include wide-mouthed tops for filling the backpack with water. The food-safe liner includes a spout for dispensing the water. Additionally, the carrier bag and the food-safe liner can be rolled down and secured with ties, in order to keep the backpack closed during transportation. It is an advantage of various embodiments of the invention that the liner may be easily removed for drying and sterilization. In this regard, the liner is configured to lay flat for solar water disinfection (SODIS) of the liner. Another advantage of the liner is the open top configuration of the liner which facilitates ease of filling and cleaning. The backpack also includes a bottom configured to provide a stable base to stand the bag upright. The components of the water backpack can be provided such as in a kit for local manufacture.

Figure 1A:
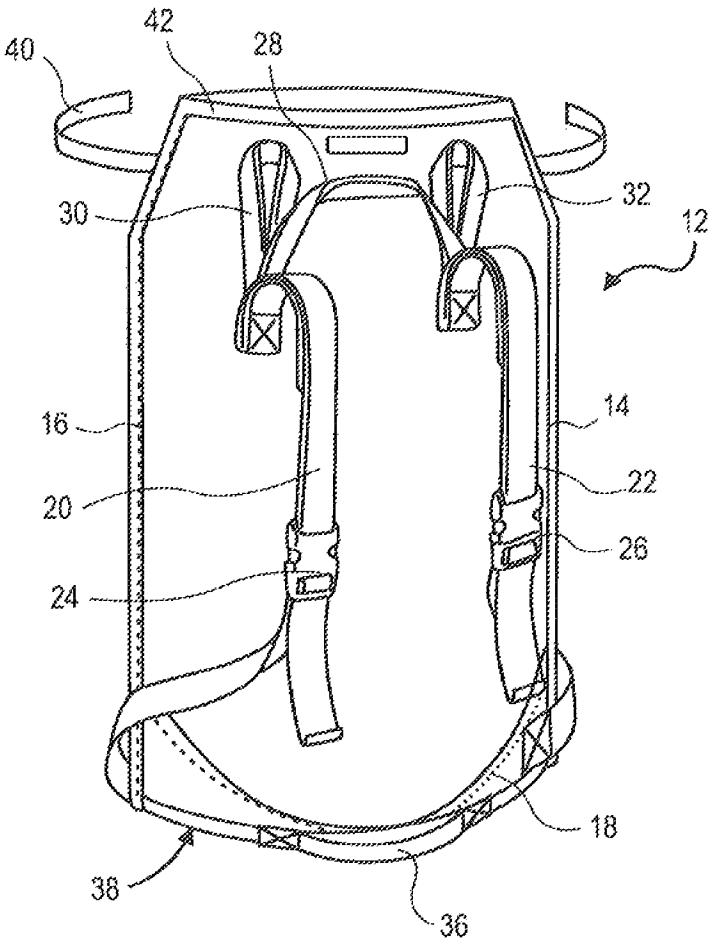
FIGS. 1 and 1A illustrate a front and back view of a water carrier bag in accordance with an embodiment of the invention.
Figure 1:
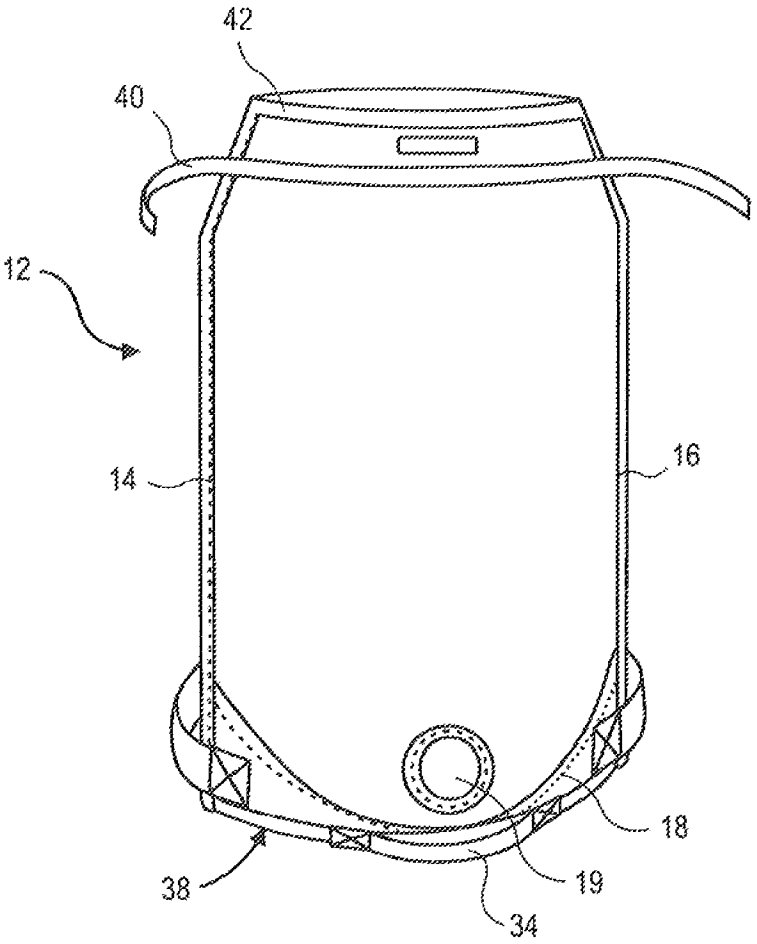

The invention will now be described with reference to the drawing figures, in which like reference numerals refer to like parts throughout. FIGS. 1 and 1A illustrate a front and back view of the carrier bag component 12 of the water backpack 10. The water backpack 10 can include a carrier bag 12. The carrier bag 12 can be formed from a lightweight and durable polymer or natural fiber cloth, or any other suitable and quick drying material. In one preferred example, the material of the carrier bag can be a flexible intermediate bulk container (FIBC) material, such as polypropylene, high density polyethylene. FIBC is extruded into threads and then woven into a fabric. FIBC is generally strong, tear resistant and UV-light resistant. It is also preferable that the material for the carrier bag can easily be fused or sewn together, such that the carrier bags can be constructed locally. As illustrated in FIGS. 1 and 1A the carrier bag 12 can be constructed by sewing side seams 14 and 16 as well as bottom seam 18. A hole 19 can be defined by the carrier bag, such that a spout of the liner bag (not shown) can be placed through the carrier bag 12. The carrier bag 12 can be configured to hold any volume of water for transport. Preferably, the carrier bag 12 can be configured to hold up to 20 liters of water when worn as a backpack.

Also, as illustrated in FIGS. 1 and 1A, the carrier bag 12 can include a number of straps and handles. For example, the carrier bag 12 illustrated in FIGS. 1 and 1A includes shoulder straps 20 and 22 for a user to carry the bag over her shoulders. These shoulder straps 20 and 22 can be shortened or lengthened by adjusting components 24 and 26. The carrier bag 12 also includes a top handle 28, such that the bag 12 can be carried in one hand, hung from a hook or branch, or lifted off the ground to move it to another location. The carrier bag 12 can also include comfort handles 30 and 32 mounted proximate to the upper connection of the shoulder straps 20 and 22 to allow the user to provide additional support against the weight of the bag 12 when navigating steep terrain. Additionally, the bag 12 can include bottom handles 34 and 36 on opposite sides of the flattened bottom 38 of the carrier bag 12, so as to enable pulling said bottom open. Tie 40 is positioned near the top of the carrier bag, such that when the bag 12 is filled the top 42 can be rolled down and secured with tie 40. The shoulder straps 20 and 22, the top handle 28, and the bottom handles 34 and 36 can all be formed from a polymer, a natural fiber, or any other suitable fabric for forming the various straps and handles.

Figure 2A:
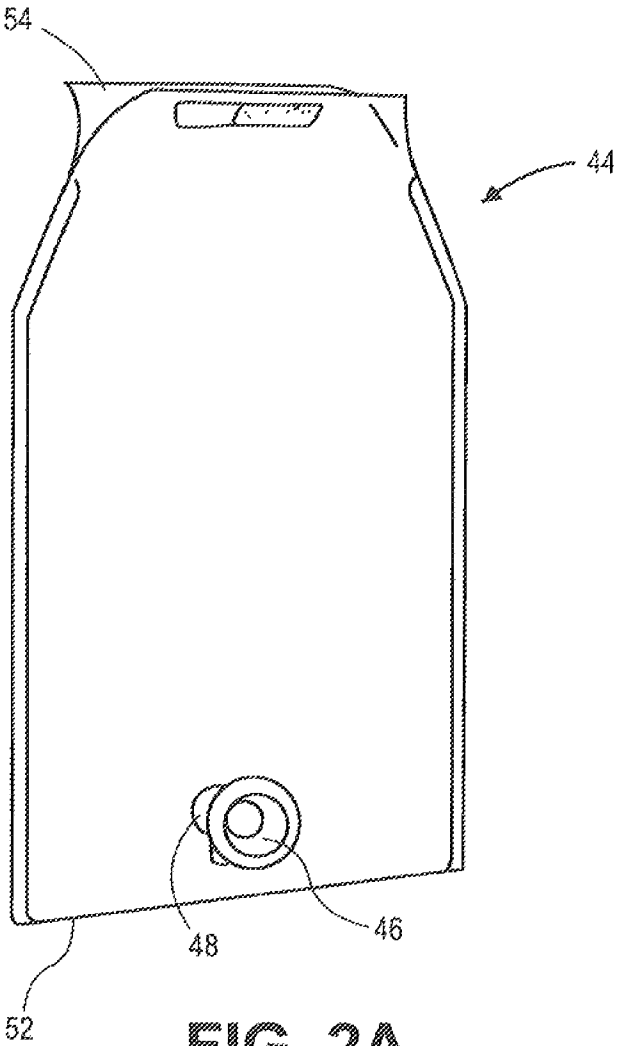
FIGS. 2 and 2A illustrate a front and back view of a water dispensing liner in accordance with an embodiment of the invention.
Figure 2:
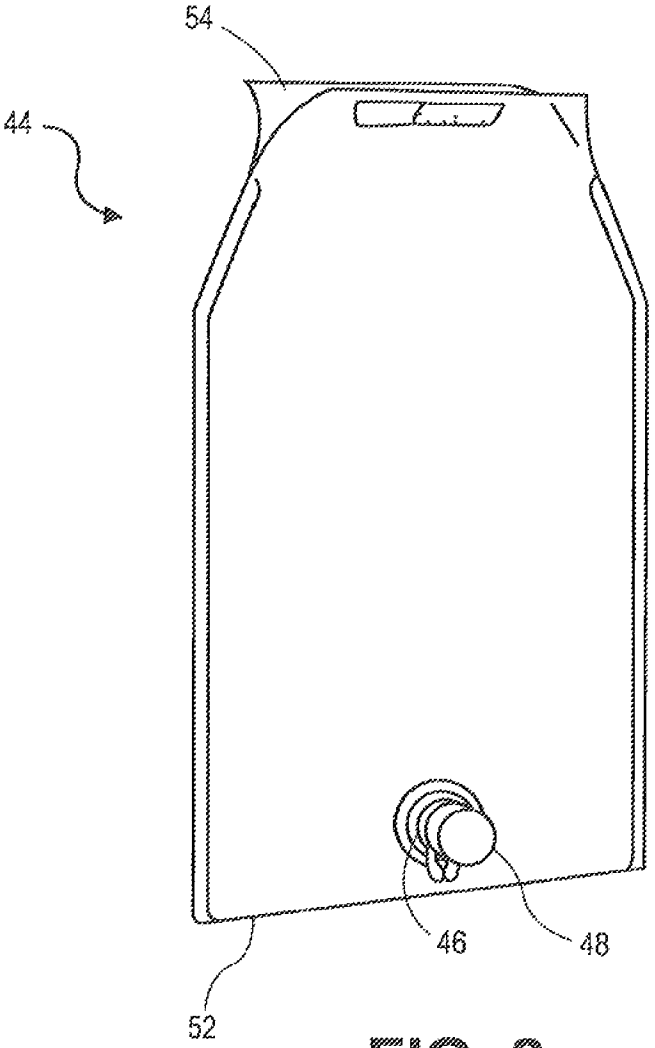
Figures 3, 3A, 3B, 3C, 3D, 3E:
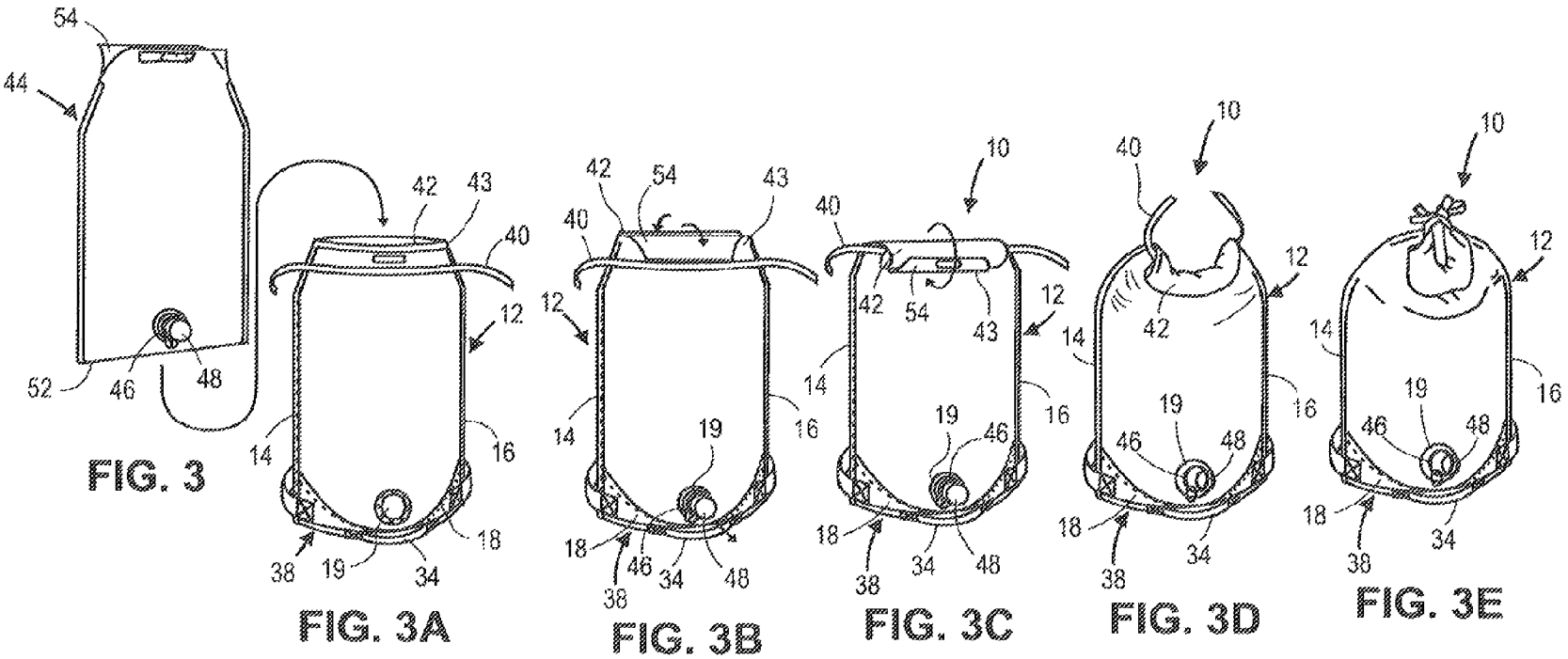
FIGS. 3-3E illustrate the process of preparing the water backpack for use and sealing the water backpack after it has been filled, in accordance with an embodiment of the invention.

FIGS. 2 and 2A illustrate a liner bag for insertion into the carrier bag 12 illustrated in FIGS. 1 and 1A. The liner 44 can be formed from a polymer or any other suitable and food-safe material. The liner 44 should be configured to be water-tight. The liner can include a spout 46 to allow for water to be dispensed from the liner 44. The spout 46 is configured to be sealed using a cap 48. The cap 48 can be secured to the spout via any suitable means such as a threaded cap to screw on to the spout 46 or a cap 48 that uses a frictional fit. In addition or alternatively, the spout 46 may include a valve or faucet to control the flow of water therethrough. The liner 44 can be removed from the backpack 10 and re-used or replaced, which allows the backpack 10 to be renewed without replacing all of its components. This allows the interior of the liner 44 to be disinfected using solar water disinfection methods, namely the SODIS method. Alternately, instead of inserting a liner bag into the carrier bag the material of the carrier bag can be coated with a waterproof laminate material which would serve the same purpose as the liner, and a spout may thus be formed on the carrier bag itself FIGS. 3-3E illustrate the insertion of the liner 44 into the carrier bag 12 and sealed in preparation for transportation. FIGS. 3 and 3A illustrate the insertion of the liner 44 into the carrier bag 12. The liner 44, shown in FIG. 3 is inserted bottom end 52 first through the opening 50 in the top 42 of the bag 12 shown in FIG. 3A. Preferably, the liner should be situated in the carrier bag such that the spout 46 protrudes from hole 19 in the carrier bag 12. Of note, the spout 46 is elevated above the bottom end 52 and is configured to remain above the ground during filling and when filled with water in order to reduce contamination of the spout 46. FIGS. 3B and 3C illustrate the top 42 of the bag 12 and top 54 of the liner 44 being folded over to keep any water filled in the backpack 10 from spilling or leaking out. The top 42 can include a rigid top edge 43. The rigid top edge 43 can act as a spool to roll down the top 42 of the backpack. As illustrated in FIGS. 3D and 3E, the tie 40 can be secured to keep the top 42 of the bag 12 and the top 54 of the liner 44 in the folded over position. Keeping the top 42 of the bag 12 and the top 54 of the liner 44 sealed can prevent the water contained within from becoming contaminated or from spilling out.

Figure 4A:
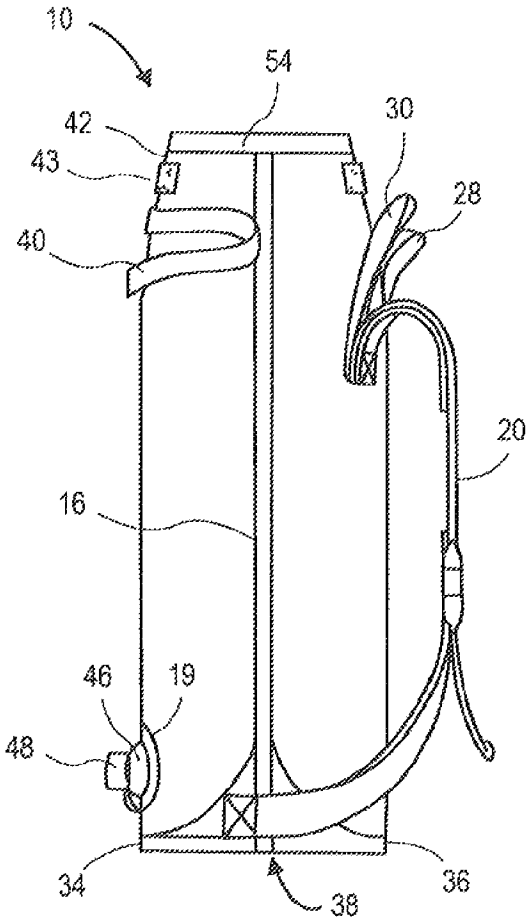
FIGS. 4 and 4A illustrate a perspective view and a side view of the assembled water backpack in accordance with an embodiment of the invention.
Figure 4:
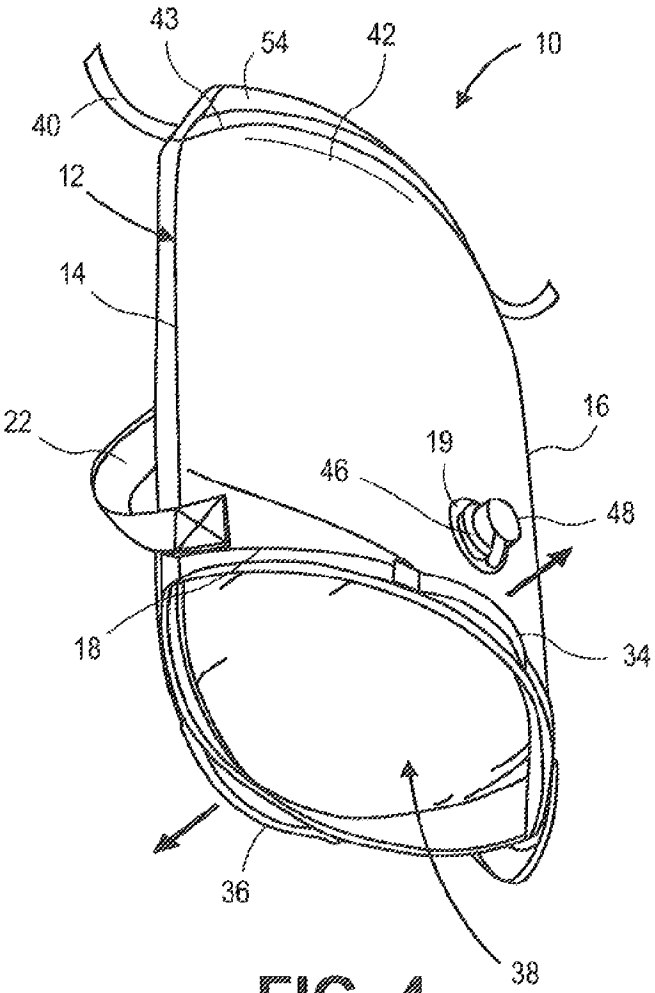

FIGS. 4 and 4A illustrate a perspective view and a side view of the assembled water backpack in accordance with an embodiment of the invention. The water backpack 10 includes the carrier bag 12 and liner 44. The carrier bag 12 can be formed from a lightweight and durable polymer or natural fiber cloth, or any other suitable and quick drying material. It is also preferable that the material for the carrier bag can easily be fused or sewn together, such that the carrier bags can be constructed locally. The carrier bag 12 can be constructed by sewing side seams 14 and 16 as well as bottom seam 18. The hole 19 can be defined by the carrier bag, such that the spout 46 of the liner bag 44 can be placed through the carrier bag 12. The carrier bag 12 also includes a number of straps and handles. For example, the carrier bag 12 includes shoulder straps 20 and 22 for a user to carry the bag over her shoulders. These shoulder straps 20 and 22 can be shortened or lengthened by adjusting components 24 and 26. The carrier bag 12 also includes a top handle 28, such that the bag 12 can be carried in one hand, hung from a hook or branch, or lifted off the ground to move it to another location. The carrier bag 12 can also include comfort handles 30 and 32 mounted in the shoulder straps 20 and 22 to allow the user to provide additional support against the weight of the bag 12 when navigating steep terrain. Additionally, the bag 12 can include bottom handles 34 and 36 for pulling open the flattened bottom 38 of the carrier bag 12. These bottom handles 34 and 36 can be pulled open before the backpack 10 is filled to provide the most space possible for the water to fill the backpack 10. This "doy" pack style flattened bottom 38 allows the user to set the bag 12 down on a surface with reduced risk of the bag being tipped over and spilling the water contained within. Tie 40 is positioned near the top of the carrier bag, such that when the bag 12 is filled the top 42 can be rolled down and secured with tie 40. The shoulder straps 20 and 22, the top handle 28, and the bottom handles 34 and 36 can all be formed from a polymer, a natural fiber, or any other suitable fabric for forming the various straps and handles.

Figure 6:
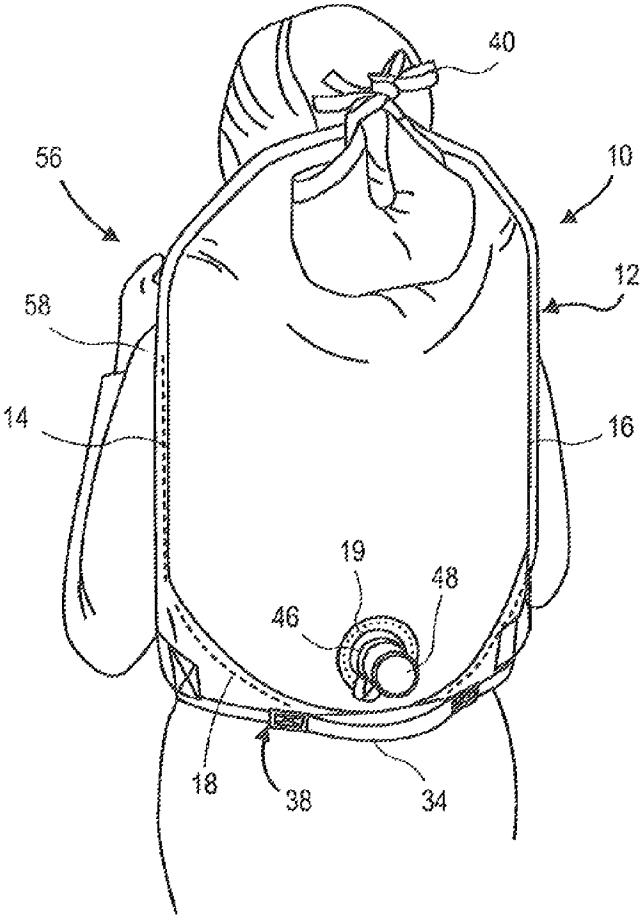
FIG. 6 illustrates a back view of a person carrying an assembled and filled water backpack in accordance with an embodiment of the invention.
Figure 5:
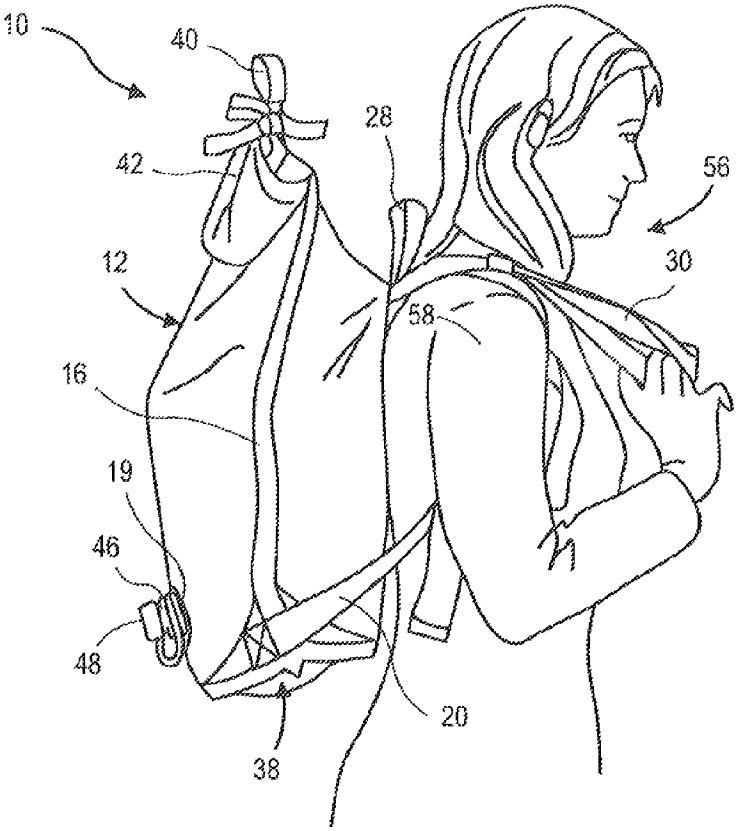
FIG. 5 illustrates a side view of a person carrying an assembled and filled water backpack in accordance with an embodiment of the invention.

FIGS. 4 and 4A also illustrate the liner bag inserted into the carrier bag 12. The liner 44 can be formed from a polymer or any other suitable and food-safe material. The liner 44 should be configured to be water-tight. The liner can include the spout 46 to allow for water to be dispensed from the liner 44. The spout 46 protrudes through hole 19. The spout 46 is preferably configured to be sealed using the cap 48. The cap 48 can be secured to the spout via any suitable means such as a threaded cap to screw on to the spout 46 or a cap 48 that uses a frictional fit. FIG. 5 illustrates a side view of the water backpack 10 being carried on a user's back and FIG. 6 illustrates a back view of the water backpack being carried on a user's back. As illustrated in FIGS. 5 and 6, the shoulder straps 20 and 22 are worn over a user's 56 shoulders 58. The user 56 can also hold onto comfort handles 30 and 32 to provide additional support and allow the user 56 to distribute some of the weight of the water carried in the backpack 10.

Figure 7:
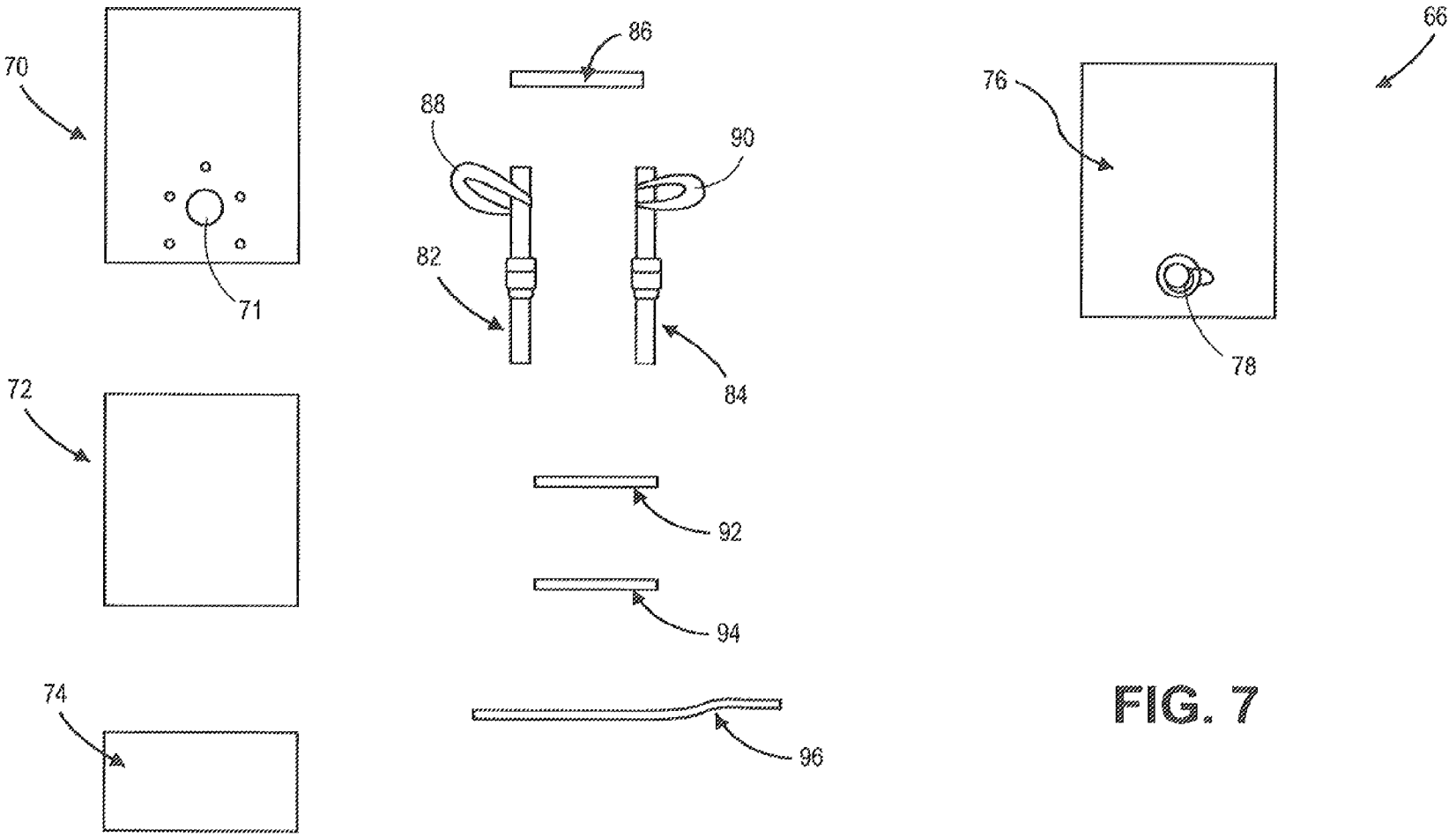
FIG. 7 illustrates a kit for assembling a water backpack locally, in accordance with an embodiment of the invention.

FIG. 7 illustrates a kit for manufacturing a water backpack locally. The kit 66 can be provided to be manufactured locally to provide jobs in countries where the water backpack will ultimately be used. The kit 66 includes punch outs 70, 72, 74 made from a polymer or natural fiber material for forming a carrier bag. The punch outs 70, 72, 74 can be sewn or fused together using any suitable means such as sewing the punch outs together. Punch out 70 can be used for the front of the carrier bag. Punch out 72 can be used for the back of the carrier bag, and punch out 74 can be used for the bottom of the carrier bag. The kit 66 can include the polymer liner 76 having an incorporated spout 78. Punch out 70 defines a hole 71 for inserting the spout 78 of a polymer liner 76. The liner can also be manufactured and distributed locally, proving an opportunity for a locally owned micro-business to manufacture and sell locally. The kit 66 can also include various handles and straps for attachment to the backpack 80. More particularly, the kit can include shoulder straps 82 and 84, top handle 86, comfort handles 88 and 90, and bottom handles 92 and 94. The handles can be made from a polymer or natural fiber fabric that is lightweight and durable. The kit 66 can also include a top tie 96 to ensure that if the top of the completed backpack is folded down that the bag can be secured in a closed position. The handles and the tie can be attached to the backpack using any suitable method, such as sewing.

Figure 8:
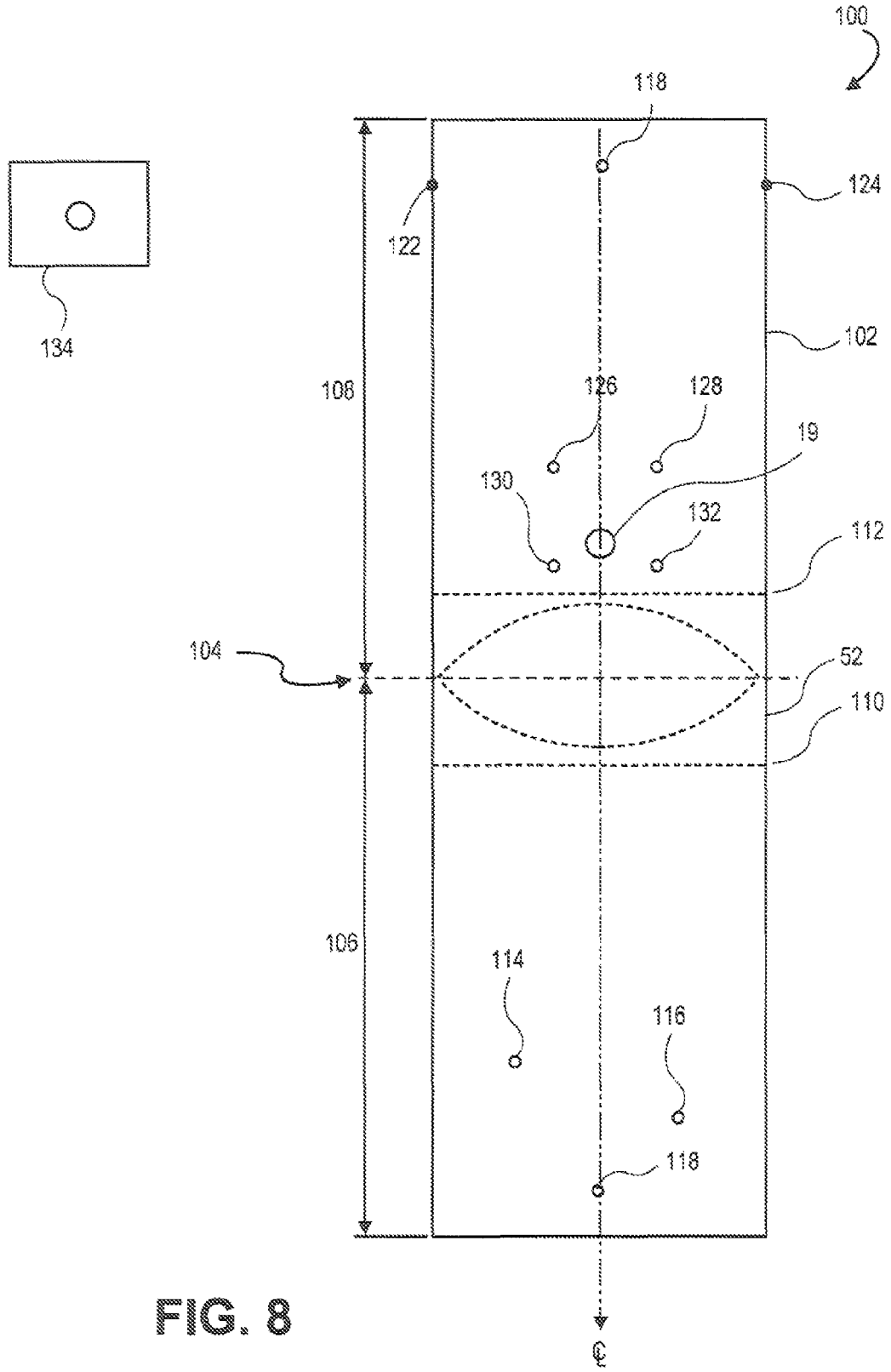
FIG. 8 is a pattern for a water backpack in accordance with an embodiment of the invention.

FIG. 8 is a pattern 100 for a water backpack 10 in accordance with an embodiment of the invention. As shown in FIG. 8, the pattern 100 is a single, elongated piece of fabric 102 that includes a midpoint fold 104 that divides the fabric 102 into a first half 106 and second half 108. The first half 106 includes a first fold 110 and the second half 108 includes a second fold 112. The bottom end 52 is defined by the first fold 110 and the second fold 112. The first half 106 includes attachment points 114 and 116 for the shoulder straps 20 and 22 (shown particularly in FIG. 2A). The first half 106 optionally includes an attachment point 118 for a releasable fastener 120 (shown in FIG. 10). The second half 108 includes the hole 19 which is configured to allow the spout 46 (shown in FIG. 2) to pass through. In addition, the hole 19 may be configured to allow a valve, spigot, or the like to pass from the liner 44 (shown in FIG. 2) through the water backpack 10 (shown particularly in FIG. 3B). Of note, while the spout 46 with the cap 48 is shown in FIG. 3B, in another example, the spout and cap may be replaced with a conventional spigot and valve device to control the flow of water therethrough. If used, the spigot may be sized to accept a conventional hose to direct the flow of water from the spigot.

Returning to FIG. 8, the second half 108 includes attachment points 122 and 124 for the ties 40 (shown in FIGS. 3A-3C) and the attachment point 118 for the optional releasable fastener 120. The second half 108 further includes a set of marks 126-132 for securing an optional valve reinforcement 134 and an optional valve cover 136 (shown in FIG. 14).

The bottom 52 includes sewing or stitching lines 138. As shown in FIG. 8, the stitching lines 138 generally form a oval shape or a shape defined by a mirror imaged pair of arcs. This shape is more particularly described as being defined by connecting four tangent ogives.

Figure 9:
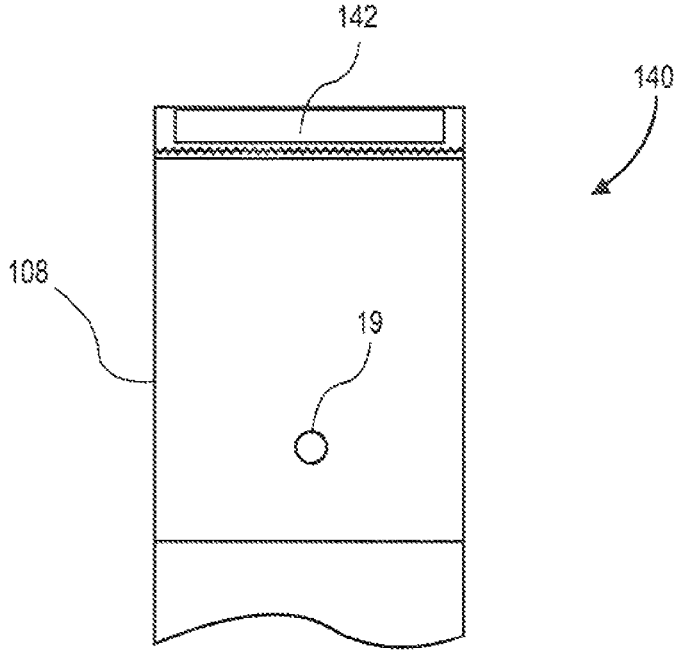
FIG. 9 is a pattern for an optional edge detail of the water backpack in accordance with FIG. 8.

FIG. 9 is a pattern 140 for an optional edge detail of the water backpack 10 in accordance with FIG. 8. As shown in FIG. 9, a stiffening member 142 is optionally affixed to a top edge of the second half 108. The stiffening member 142 may include any suitable material. Examples of suitable materials include, polymer foam, polymers, wood, metal, and the like. In a particular example, the stiffening member 142 is a polymer foam.

Figure 10:
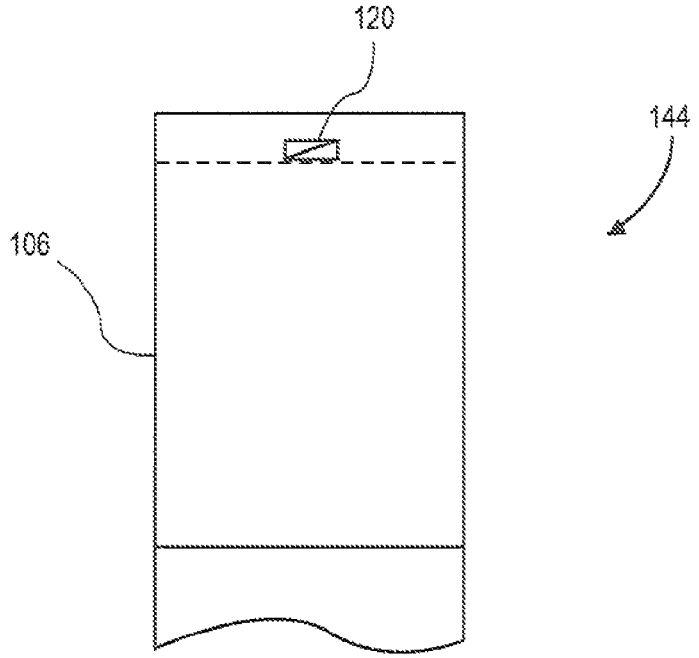
FIG. 10 is a pattern for an optional edge detail of the water backpack in accordance with FIG. 8.

FIG. 10 is a pattern 144 for an optional edge detail of the water backpack 10 in accordance with FIG. 8. As shown in FIG. 10, the releasable fastener 120 is optionally affixed to a top edge of the first half 106. If utilized, the releasable fastener 120 may include any suitable releasable device of substance such as, for example, hook and loop fasteners, sticky or tacky tape or substance, buttons, zippers, magnets, ties, clips, and the like. In a particular example, the releasable fastener 120 is a hook and loop type fastener such as VELCRO®.

Figure 11:
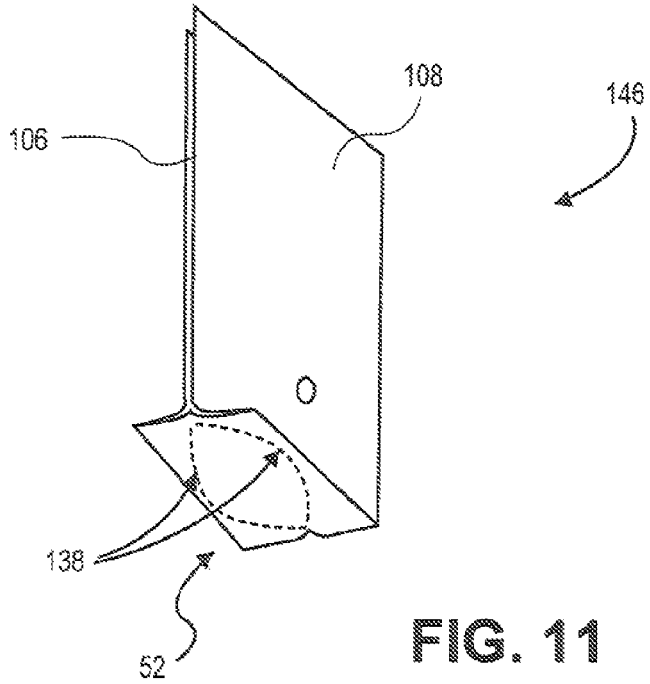
FIG. 11 is a pattern for a bottom portion of the water backpack in accordance with FIG. 8.

FIG. 11 is a pattern 146 for the bottom end 52 of the water backpack 10 in accordance with FIG. 8. As shown in FIG. 11, the bottom end 52 is stitched along the stitching lines 138. The stitches pass through the bottom end 52 and the sides of the water backpack 10 to form a sturdy base upon which the water backpack 10 may be stood upright.

Figure 12:
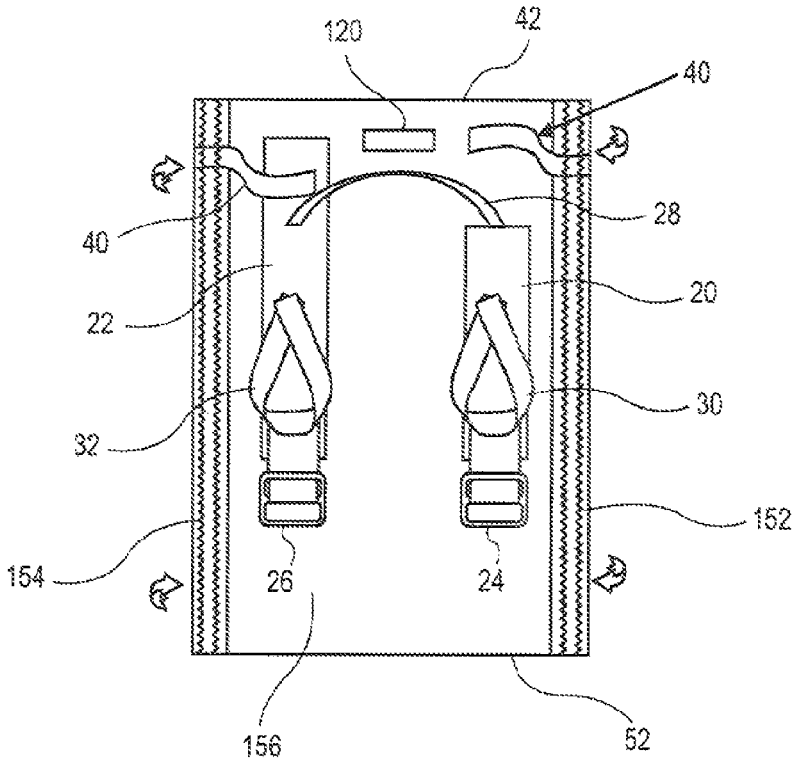
FIG. 12 is a pattern for a front portion of the water backpack in accordance with FIG. 8.

FIG. 12 is a pattern 148 for a front portion 150 of the water backpack 10 in accordance with FIG. 8. As shown in FIG. 12, side edge seams 152 and 154 of the water backpack 10 are formed by folding over and stitching each side to form an envelope or body 156. The pattern 148 also depicts the placement of the shoulder straps 20 and 22, adjusting components 24 and 26, top handle 28, comfort handles 30 and 32, and releasable fastener 120.

Figure 13:
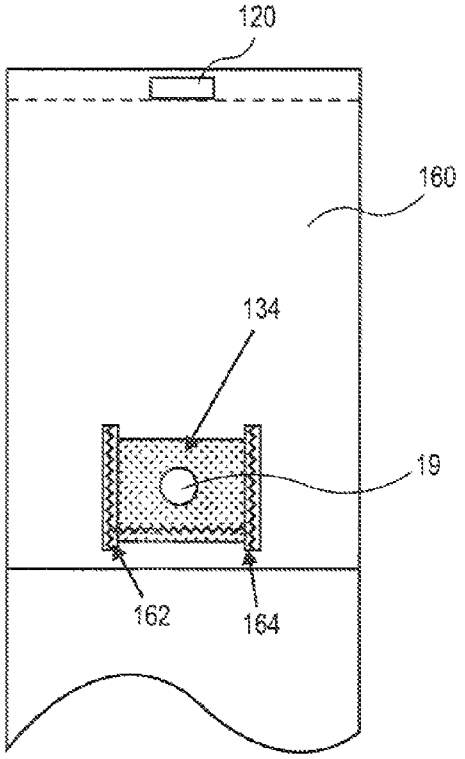
FIG. 13 is a first pattern for a back portion of the water backpack in accordance with FIG. 8.

FIG. 13 is a first pattern 158 for a back portion 160 of the water backpack 10 in accordance with FIG. 8. As shown in FIG. 13, the valve reinforcement 134 is optionally disposed upon the back portion 160 such that the hole 19 is in alignment. If utilized, the valve reinforcement 134 is stitched in place and releasable fasteners 162 and 164 are optionally affixed as well. If utilized, the releasable fasteners 162 and 164 include any suitable releasable fastener such as those already described with reference to the releasable fastener 120, for example.

Figure 14:
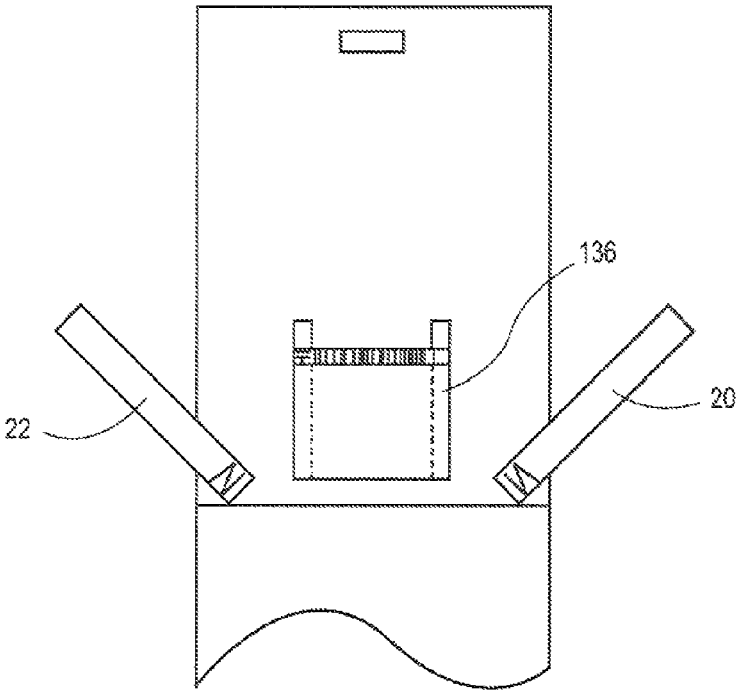
FIG. 14 is a second pattern for a back portion of the water backpack in accordance with FIG. 8.

FIG. 14 is a second pattern 166 for the back portion 160 of the water backpack 10 in accordance with FIG. 8. As shown in FIG. 14, the second pattern 166 depicts the lower attachment points of the shoulder straps 20 and 22 and the placement of the optional valve cover 136. If included, the valve cover 136 is configured to provide protection for the valve or spout 78 and facilitates keeping the spout 78 clean. In this manner, contamination and wear on the spout 78 may be reduced.

Figure 15:
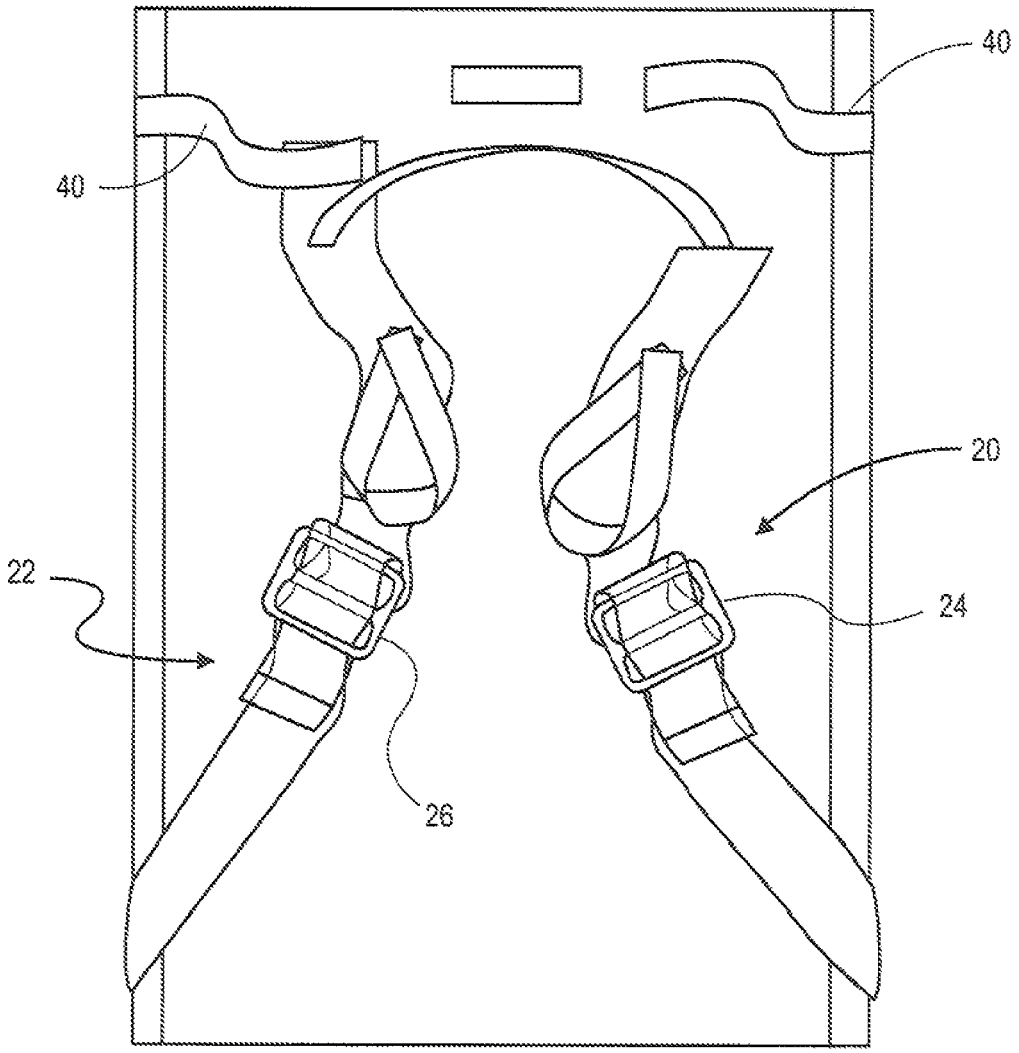
FIG. 15 is an illustration of a front portion of an assembled water backpack in accordance with FIG. 8.

FIG. 15 is an illustration of the front portion 150 of an assembled water backpack 10 in accordance with FIG. 8. As shown in FIG. 15, the shoulder straps 20 and 22 are assembled by bringing the lower portions of the straps around to thread through the adjusting components 24 and 26. The overall length of the shoulder straps 20 and 22 may be adjusted, via the adjusting components 24 and 26, to the preference of individual users by varying the length of the shoulder straps 20 and 22.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A backpack for carrying water, the backpack comprising:

a flexible body defining a maximum interior volume, wherein the flexible body comprises:

an elongated piece of fabric, the fabric having a first half as measured from a first end of the fabric to a midpoint in a long axis of the fabric, the fabric having a second half as measured from a second end of the fabric to the midpoint;

a bottom to provide sufficient support to the backpack for the backpack to be self-standing, wherein the bottom is defined by three folds forming a pleat disposed transversely across the long axis, the three folds comprising:

a midpoint fold disposed at the midpoint;

a first fold disposed in the first half proximal to the midpoint, the first fold defining a boundary between a front side and a first bottom portion, the first bottom portion is defined by the portion of the fabric disposed between the first fold and the midpoint fold; and a second fold disposed in the second half proximal to the midpoint, the second fold defining a boundary between a back side and a second bottom portion, the second bottom portion is defined by the portion of the fabric disposed between the second fold and the midpoint fold;

a first semi-circular stitching affixing the first bottom portion to the front side to form a tangent ogive having a point at an edge of the fabric and being semi-circular at the crossing of the first semi-circular stitching with the long axis;

a second semi-circular stitching affixing the second bottom portion to the back side to form a tangent ogive having a point at the edge of the fabric and being semi-circular at the crossing of the second semi-circular stitching with the long axis;

a lower opening being disposed in a back side of the flexible body, the lower opening being located proximal to the bottom;

a cover to selectively cover and uncover the lower opening;

a cover fastener to releasably fasten the cover, wherein the cover fastener is a hook and loop fastener;

an upper opening being defined by the first end of the fabric and the second end of the fabric;

a pair of ties being disposed at opposite edges of the upper opening, the pair of ties being configured to secure a roll closure of the upper opening in response to being drawn together and tied; and a stiffening member sewn into the second end to facilitate the roll closure; and a liner comprising:

a translucent polymer envelope being larger than the maximum interior volume;

a valve configured to protrude through the lower opening; and an upper liner opening cooperatively aligned with the upper opening; and a pair of straps including a first strap and a second strap, each strap of the pair of straps having a first strap end being affixed on the front side about half way between the first fold and the first end of the fabric and with a right side first strap end being affixed to a right side of the long axis and a left side first strap end being affixed to a left side of the long axis, each strap having a second strap end being affixed to the back side adjacent to the second fold and with a right side second strap end being proximal to a right edge of the fabric and a left side second strap end being proximal to a left edge of the fabric, wherein the first strap end of the first strap is affixed relatively closer to the upper opening than the first strap end of the second strap; and a hoist strap having a first hoist end and a second hoist end, the first hoist being affixed to the first strap below the first strap end of the first strap and level with the first strap end of the second strap and the second hoist end being affixed to the first strap end of the second strap.

2. The backpack according to claim 1, further comprising:

an adjuster for each strap of the pair of straps to modify a length of each strap.

3. The backpack according to claim 2, wherein the adjuster is a tri-glide.

4. The backpack according to claim 1, further comprising:

a pair of liner ties being disposed at opposite edges of the upper liner opening, the pair of liner ties being configured to secure a liner roll closure of the upper liner opening in response to being drawn together and tied.

5. The backpack according to claim 1, further comprising:

a releasable fastener disposed along the upper opening and the upper liner opening to releasably fasten the liner to the flexible body.

6. The backpack according to claim 5, wherein the releasable fastener is a hook and loop fastener.

7. The backpack according to claim 1, wherein the translucent polymer is high density polyethylene.

8. The backpack according to claim 1, further comprising:

a pair of hand loops, each one of the pair of hand loops being disposed on a respective strap of the pair of straps proximal to the respective first strap end.

9. The backpack according to claim 1, wherein the stiffening member is a strip of medium density foam extending across the upper opening.

10. The backpack according to claim 1, wherein the liner is removable from the rest of the backpack.

* * * * *